US006773330B1

(12) United States Patent
Cohen

(10) Patent No.: US 6,773,330 B1
(45) Date of Patent: Aug. 10, 2004

(54) EXPANDABLE TOY

(76) Inventor: Lori Adams Cohen, 18 Magnolia La., East Hills, NY (US) 11577

( * ) Notice: Subject to any disclaimer, the term of this patent is extended or adjusted under 35 U.S.C. 154(b) by 0 days.

(21) Appl. No.: 10/600,054

(22) Filed: Jun. 20, 2003

(51) Int. Cl.[7] ..... A63H 33/00
(52) U.S. Cl. ..... 446/486; 446/369; 446/226
(58) Field of Search ..... 446/220–226, 446/369, 370–372, 486

(56) References Cited

U.S. PATENT DOCUMENTS

| | | | | | |
|---|---|---|---|---|---|
| 1,216,425 | A | | 2/1917 | Eiseman | |
| 2,685,758 | A | | 8/1954 | Ochs | |
| 4,505,687 | A | * | 3/1985 | Munro | 446/368 |
| 5,613,892 | A | * | 3/1997 | Barton | 446/226 |
| 5,649,875 | A | | 7/1997 | Spector | |
| 5,727,979 | A | | 3/1998 | Spector | |
| 5,813,896 | A | | 9/1998 | Spector | |
| 6,039,327 | A | | 3/2000 | Spector | |
| 6,093,077 | A | | 7/2000 | Spector | |
| 6,126,510 | A | * | 10/2000 | Weiss, Jr. | 446/486 |
| 6,439,950 | B1 | * | 8/2002 | Goldman et al. | 446/220 |

* cited by examiner

*Primary Examiner*—Derris H. Banks
*Assistant Examiner*—Jamila Williams
(74) *Attorney, Agent, or Firm*—Collard & Roe P.C.

(57) ABSTRACT

An expandable toy having a plurality of fabric panels joined along their sides forming a desired shape and defining an interior space. These panels also define a single aperture at the top of the toy that provides access to the interior space. A plurality of elastic bands run along the interior surface of the fabric panels. An inflatable device is disposed within the interior space and the neck of the inflatable device is accessible through the single aperture at the top of the toy. Air is forced into the inflatable device, expanding the inflatable device and when large enough expanding the plurality of elastic bands so that the toy may achieve a desired size. The inflatable device is then sealed and a fabric lid is closed to cover the single aperture when the desired size is achieved.

12 Claims, 5 Drawing Sheets

EXPANDABLE TOY

BACKGROUND OF THE INVENTION

The invention relates to an expandable toy that may be internally inflated and has animal features. The size of the toy is determined by the user and may range from uninflated to fully inflated.

Toy figures are universally popular. Typically figures such a teddy bears are filled with cotton batting and covered with a fur-like plush fabric. However, those filed with batting only remain one size and do not provide for easy packing or storage.

U.S. Pat. No. 2,685,758 to Ochs discloses a Humpty-Dumpty inflatable toy. U.S. Pat. No. 5,649,875 to Spector discloses a humanoid toy missile. U.S. Pat. No. 5,813,896 to Spector discloses collapsible stuffed toy figures.

The present invention discloses a toy that may be inflated but still has a plush exterior. This plush exterior provides support to the animal when uninflated so that it still retains a shape and expands with an inflatable device increasing the outer surface area of the toy. The toy can also be deflated to provide for easy storage and washing.

SUMMARY OF THE INVENTION

The present invention relates to an expandable toy. A plurality of fabric panels are joined along their sides forming seams and defining an interior space. They also define a single aperture at the top of.the toy that provides access to the interior space. A plurality of elastic bands run along the seams on the interior surfaces of the plurality of fabric panels.

These elastic bands bunch the fabric panels closer together when the toy is not inflated so that it still retains a defined shape.

An inflatable device such as a rubber balloon, is disposed within the interior space. The inflation tube of the rubber balloon is accessible through the single aperture at the top of the toy. A fabric lid covers the single aperture so that the interior space may be closed.

Air is forced into the rubber balloon, expanding the rubber balloon. When the rubber balloon is large enough to reach the interior surface it begins to expand the plurality of elastic bands. The balloon is inflated until the fabric panels are fully extended or until the user has reached a desired size. The rubber balloon is then sealed and the fabric lid is closed to cover the single aperture.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

DETAILED DESCRIPTION OF THE PREFERRED EMBODIMENT

Figure 1:
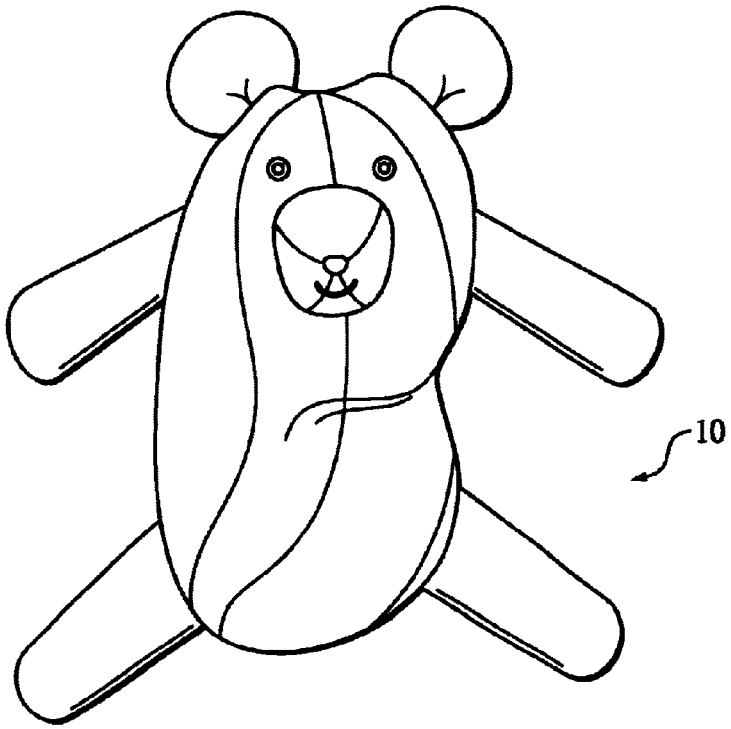
FIG. 1 shows the expandable toy in the non-expanded state.
Figure 2:
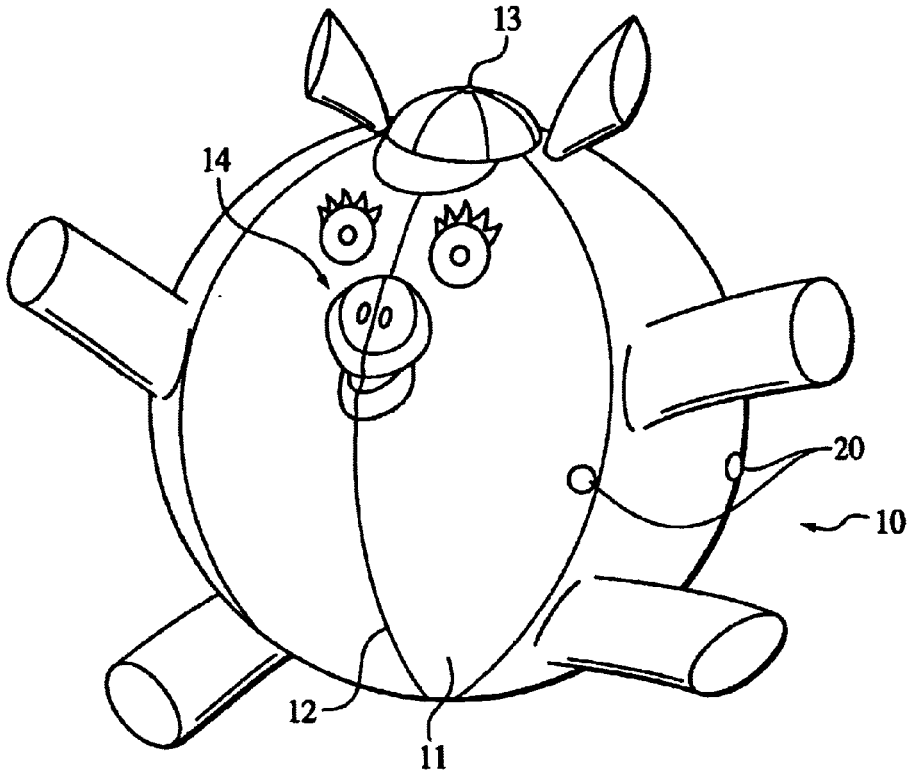
FIG. 2 shows the expandable toy in the expanded state.

Referring in detail to the drawings, FIG. 1 shows an expandable toy 10 in an unexpanded state. FIG. 2 shows expandable toy 10 in an expanded state. Expandable toy 10 is comprised of fabric panels 11 or sections whose sides are joined together forming a desired shape as well as a series of seams 12 where fabric panels 11 are joined. There are preferably six fabric panels 11 sewn together that when inflated assume a round form. Distinguishing features such as animal features 14 are disposed on the exterior of fabric panels 11. Animal features 14 include stuffed appendages (arms, legs and tail) which are sewn into seams 12 providing further structure to toy 10. Toy 10 does not include a head and neck and its face is preferably three dimensional and sewn directly onto the top front portion of toy 10.

Fabric panels 11 define an interior space as well as a single aperture or opening 17 (see FIG. 3) covered by a fabric lid 13. Fabric lid 13 may be designed to incorporate animal features 14 and is preferably shaped as a hat.

Figure 3:
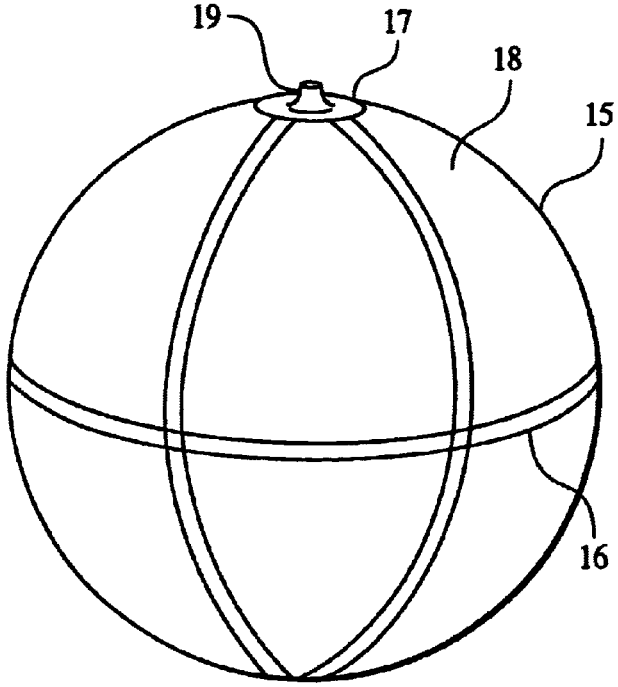
FIG. 3 shows the positioning of the elastic bands and inflatable device when the expandable toy is expanded.

FIG. 3 shows an inner layer of expandable toy 10 in an expanded state without fabric panels 11. Elastic bands or expandable members 15 are attached to the interior of fabric panels 11 and preferably run along seams 12. An inflatable device 18 is disposed within the interior space defined by fabric panels 11. Inflatable device 18 is preferably a rubber balloon but can be a beach ball or any other inflatable type device. Access to inflatable device 18 is provided through single aperture 17. An inflation tube or stem 19 of inflation device 18 protrudes from single aperture 17. As inflatable device 18 is inflated it expands toward elastic bands 15. Inflatable device 18 then expands elastic bands 15 until expandable toy 10 reaches a desired size, or until fabric panels 11 are fully expanded. Access to inflatable device 18 is then covered by lid 13. Elastic bands 15 contract when deflated giving the toy character, life and body adding to the play value. This inflatable device 18 can either be removable from inside fabric panels 11 or attached to an inside region of fabric panels 11 using a fastening element such as glue or any other adhesive.

A horizontal elastic belt or restraining member 16 preferably runs along the interior surface of fabric panels 11, so that fabric panels 11 contract at the waist of expandable toy 10 when not expanded. As shown in FIG. 2, fasteners such as snap closures 20 may be provided on an exterior surface of fabric panels 11. The two components of snap closures 20 are separated at a defined distance so that when snap closures 20 are joined, they contract that area of fabric panels 11. Other types of closures other than the snap closures can include but are not limited to buttons, VELCRO, hooks or ties. Closures 20 provide educational benefits by teaching a child how to tie, snap, or button. Elastic bands 15, elastic belt 16, and snap closures 20 all help expandable toy 10 to maintain a shape when not inflated.

Using a plush fabric of a heaver weave adds additional body and structure to toy 10 prior to inflation. Further, if a terry cloth or neoprene fabric is used the toy may be used in the bath tub or swimming pool. Prior to inflation, toy 10 may be used as a washcloth, and by inserting inflatable device 18 it can float.

Figure 4:
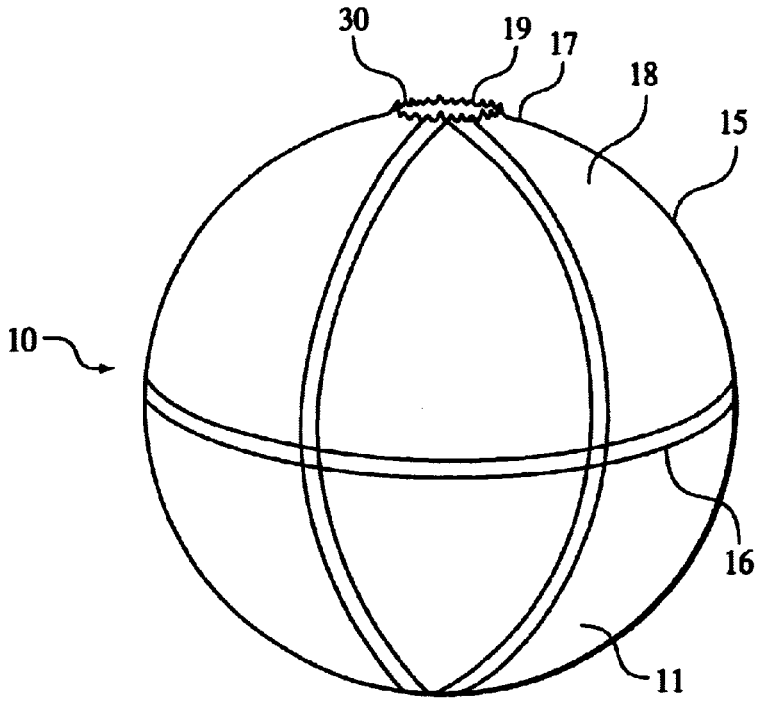
FIG. 4 shows a perspective view of an additional embodiment of the toy.

In another embodiment, as shown in FIG. 4 the device can include an elastic closure 30 disposed on a top region of toy 10. Elastic closure 30 includes an elastic band enclosed inside of fabric panels 11. Elastic closure 30 will expand to allow a balloon or additional stuffing to be placed inside of toy 10 such that panels 11 and elastic bands 15 and 16 will expand to receive this material.

Figure 5:
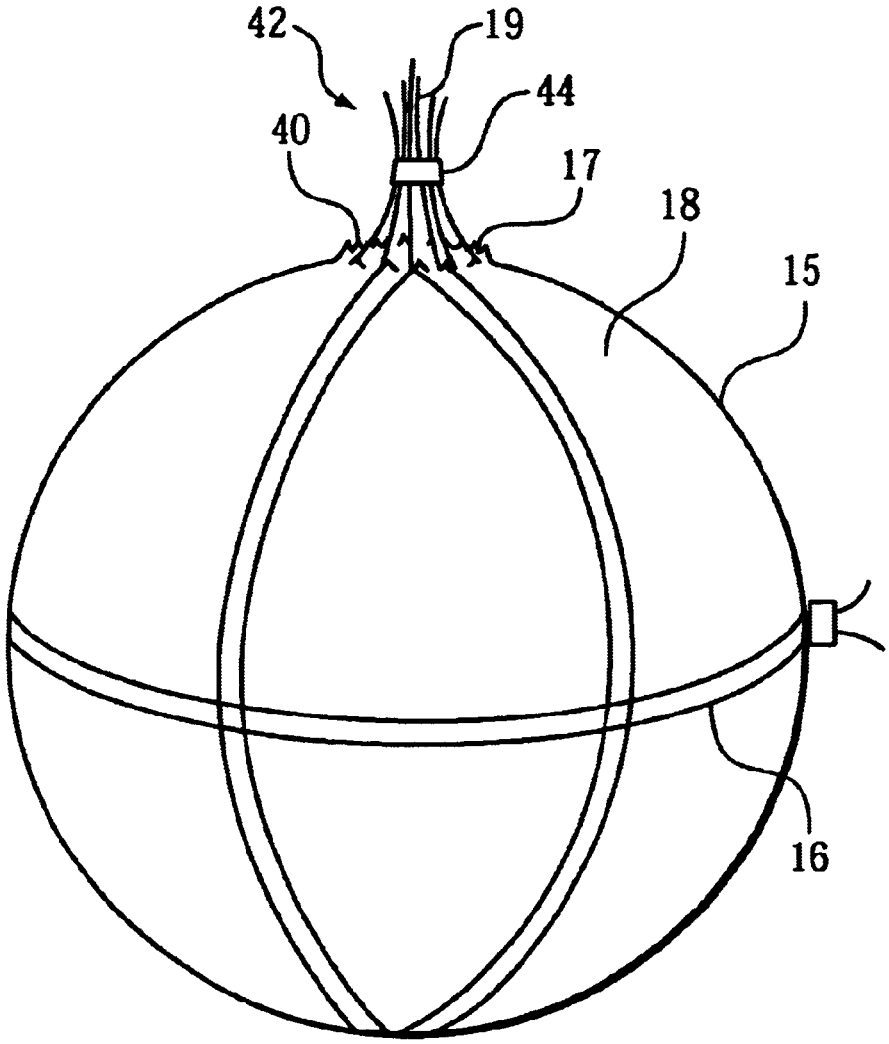
FIG. 5 shows a side perspective view of another embodiment of the device.

FIG. 5 discloses another embodiment of the invention wherein toy 10 includes a draw string closure 40 that includes a plurality of drawstrings 42 with a first set of drawstrings extending down parallel to and adjacent to expandable member 15. There is a second set of drawstrings that are enclosed inside of panels 11 near a top region of toy 10 to close drawstring closure 40 closed. A lock 44 is used to keep drawstrings 42 pulled tight.

Figure 6A:
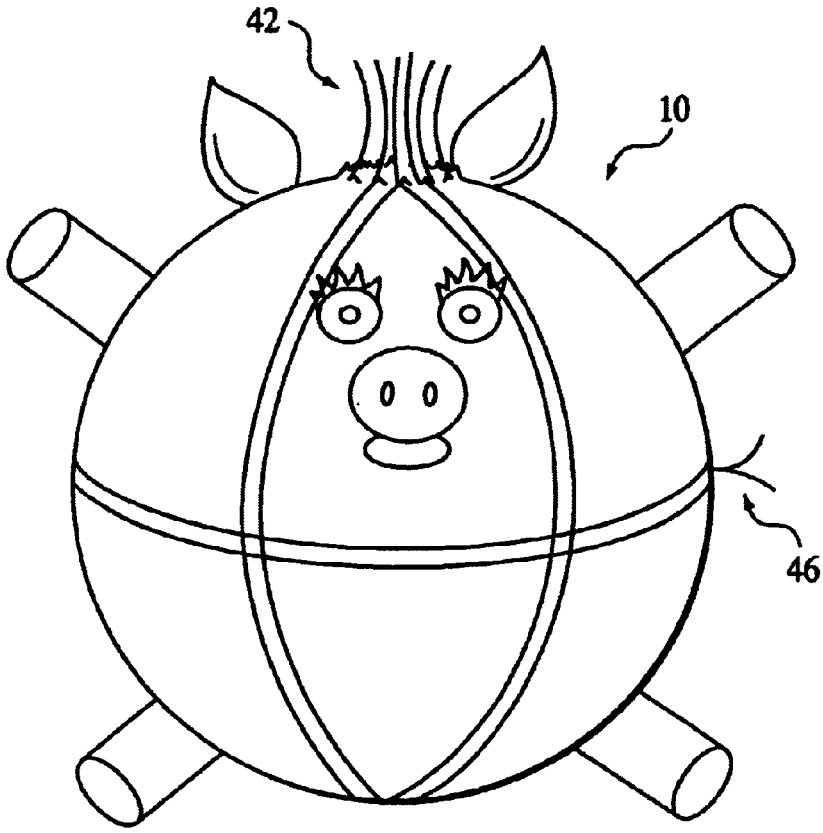
FIG. 6A shows a side perspective view of another embodiment of the device in an inflated state.
Figure 6B:
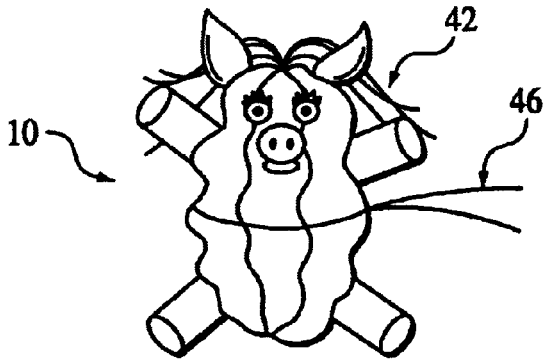
FIG. 6B shows the embodiment of FIG. 6A in a deflated state.

A side drawstring 45 can extend around a hemispherical section of toy 10 adjacent to restraining member 16. Side drawstring 46 along with drawstrings 42 can be used to allow toy 10 to be expanded as shown in FIG. 6A, or collapsed as shown in FIG. 6B.

Figure 7A:
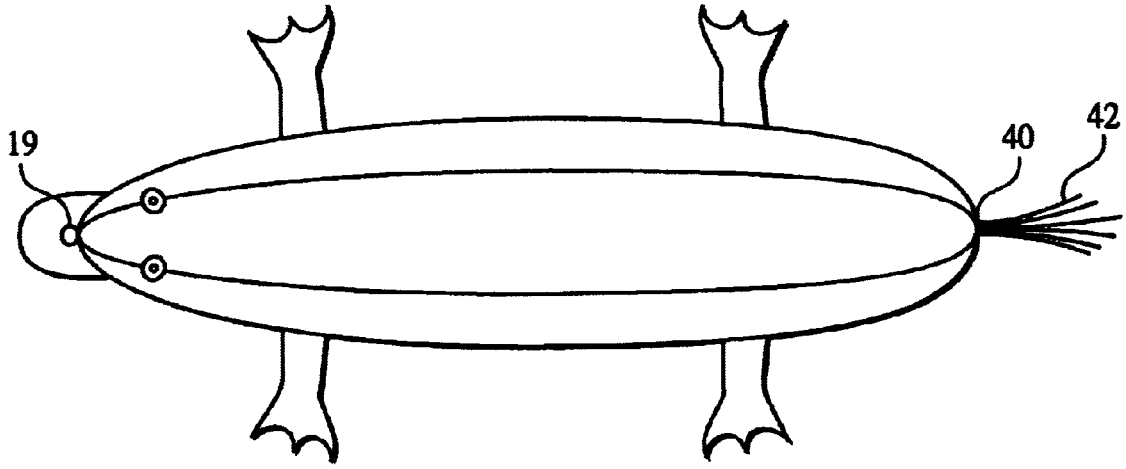
FIG. 7A shows a top view of another embodiment of the invention in an inflated state.
Figure 7B:
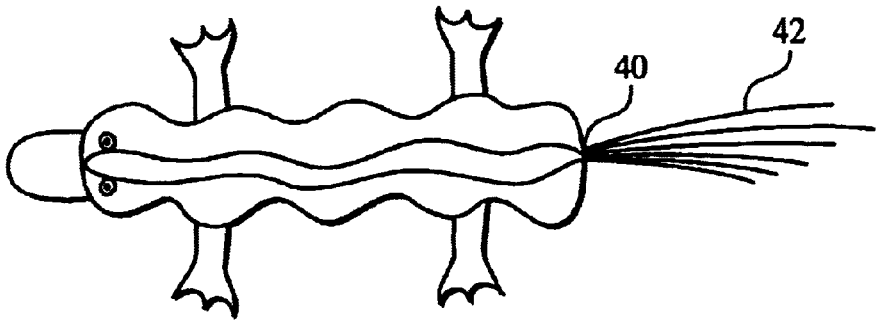
FIG. 7B shows the embodiment of FIG. 7A in a deflated state.

FIGS. 7A and 7B show the expanded and the contracted versions of an elongated toy device 10 where drawstring closure 40 and drawstrings 42 extend out of a back or a bottom end, while stem 19 of the inflatable device extends out of an opposite front end.

Accordingly, while two embodiments of the present invention has been shown and described, it is obvious that many changes and modifications may be made thereunto without departing from the spirit and scope of the invention.

What is claimed is:

1. An expandable toy comprising:

a plurality of fabric panels having an exterior and an interior surface and joined to one another along their sides forming desired shape and defining an interior space as well as at least one aperture that provides access to said interior space;

a plurality of elastic bands running along on said interior surface of said plurality of fabric panels;

an inflatable device disposed within said interior space, wherein an inflation tube of said inflation device is accessible through said at least one aperture; and a lid that removably covers said at least one aperture so that said interior space is inaccessible;

wherein air is forced into said inflation device, expanding said inflation device and said plurality of elastic bands so that the expandable toy may achieve a desired size; and wherein said inflation device is sealed and said lid covers said at least one aperture when said desired size is achieved.

2. The expandable toy of claim 1, wherein said fabric panels form seams on said exterior surface where they are joined.

3. The expandable toy of claim 2, wherein said plurality of elastic bands run along said seams on said interior surface.

4. The expandable toy of claim 1, wherein said plurality of elastic bands further comprise at least one circumferential elastic band on said interior surface of said plurality of fabric panels that encircles said interior space.

5. The expandable toy of claim 1, further comprising at least one fastener on said exterior surface of said plurality of fabric panels, wherein two components of said at least one fastener are seperated by a defined distance so that when said at least one snap closure is engaged it decreases said exterior surfaces of the expandable toy.

6. The expandable toy of claim 1, further comprising animal features on said exterior surfaces of said plurality of fabric paneled.

7. The expandable toy of claim 4, wherein said lid is a fabric hat.

8. The expandable toy of claim 6, wherein said animal features comprise a face, arms, legs and a tail.

9. The expandable toy of claim 1, wherein said inflatable device comprises a beach ball.

10. The expandable toy of claim 1, wherein said inflatable device is attached to an interior region of said fabric panels.

11. A method of expanding an expandable toy comprising the steps of:

inserting an inflation device into an interior space of the expandable toy through at least one aperture in the expandable toy;

inflating said inflation device;

increasing the size of the expandable toy when said inflation device pushes on an interior surface of the expandable toy;

expanding a plurality of elastic bands that run along said interior surfaces of the expandable toy;

ceasing inflation when the expandable toy has reached a desired size or when said expandable toy is fully expanded;

sealing said inflation device; and closing said at least one aperture with a lid so that said inflation device is inaccessible.

12. An expandable toy comprising:

a plurality of fabric panels having an exterior and an interior surface and joined to one another along their sides forming desired shape and defining an interior space as well as at least one aperture that provides access to said interior space;

a plurality of elastic bands running along on said interior surface of said plurality of fabric panels; and an inflatable device disposed within said interior space, wherein an inflation tube of said inflatable device is accessible through said at least one aperture;

wherein air can be forced into said inflatable device, expanding said inflatable device and said plurality of elastic bands so that the expandable toy may achieve a desired size.

* * * * *